US007525501B2

(12) United States Patent
Black et al.

(10) Patent No.: US 7,525,501 B2
(45) Date of Patent: Apr. 28, 2009

(54) BICONE PATTERN SHAPING DEVICE

(75) Inventors: Donald N. Black, Cumming, GA (US); Terence D. Newbury, Hoschton, GA (US); Alan Jones, Lawrenceville, GA (US); R. Dean Parr, Suwanee, GA (US); Bayne Bunce, Acworth, GA (US)

(73) Assignee: EMS Technologies, Inc., Norcross, GA (US)

( * ) Notice: Subject to any disclaimer, the term of this patent is extended or adjusted under 35 U.S.C. 154(b) by 45 days.

(21) Appl. No.: 11/706,580

(22) Filed: Feb. 12, 2007

(65) Prior Publication Data

US 2007/0205961 A1 Sep. 6, 2007

Related U.S. Application Data

(60) Provisional application No. 60/772,232, filed on Feb. 10, 2006.

(51) Int. Cl.
*H01Q 13/00* (2006.01)
*H01Q 15/02* (2006.01)

(52) U.S. Cl. ..... 343/773; 343/909; 343/911 R

(58) Field of Classification Search ..... 343/773, 343/909, 911 R

See application file for complete search history.

(56) References Cited

U.S. PATENT DOCUMENTS 2,978,702 A 4/1961 Pakan et al.
4,461,039 A * 7/1984 Hersman ..... 455/326
5,283,591 A 2/1994 Delmas
6,473,049 B2 10/2002 Takeuchi et al.
6,538,615 B1 * 3/2003 Schantz ..... 343/786
6,677,904 B2 * 1/2004 Lichtfuss ..... 343/702
7,221,326 B2 * 5/2007 Ida et al. ..... 343/773

OTHER PUBLICATIONS

PCT/US207/03953, International Search Report, Oct. 19, 2007, 1 page.

* cited by examiner

*Primary Examiner*—Hoang V Nguyen
(74) *Attorney, Agent, or Firm*—King & Spalding

(57) ABSTRACT

A broadband omni-directional bicone antenna. The antenna can comprise conductive surfaces of conical voids provided within a solid dielectric structure. The outside surface of the solid structure can support a radio frequency (RF) lens geometry operable for beam forming. The beam forming can modify the elevation pattern of the electromagnetic radiation from the bicone antenna. The solid dielectric structure may be machined or molded from a single piece of material. The conical voids provided within the solid structure can be metallized to provide conductive bicone radiators. The outer surface beam shaping lenses can be zoned or continuous and can provide elevation patterns with increased gain, cosecant squared falloff, or various other patterns. The beam shaping lens may be formed from any low-loss dielectric. Alternatively, the lens may be formed from a less dense material such as dielectric foam that can support radial conductive beam forming vanes.

24 Claims, 5 Drawing Sheets

BICONE PATTERN SHAPING DEVICE

RELATED APPLICATION

This patent application claims priority under 35 U.S.C. §119 to U.S. Provisional Patent Application No. 60/772,232, entitled "Bicone Pattern Shaping Device," filed Feb. 10, 2006. The complete disclosure of the above-identified priority application is hereby fully incorporated herein by reference.

FIELD OF THE INVENTION

The present invention relates to an omni-directional bicone antenna and more specifically to an antenna having two cone-shaped antenna elements and a beam shaping lens formed within a single blank of dielectric material.

BACKGROUND

A bicone is generally an antenna having two conical conductors, where the conical elements share a common axis, and a common vertex. The conical conductors extend in opposite directions. That is, the two flat portions of the cones face outward from one another. The flat portion of the cone can also be thought of as the base of the cone or the opening of the cone. The flat portion, or opening, of a cone is at the opposite end of the cone from the vertex or point of the cone. Bicone antennas are also called biconical antennas. Generally, a bicone antenna is fed from the common vertex. That is, the driving signal is applied to the antenna by a feed line connected at the antenna's central vertex area.

Positioning two cones so that the points (or vertices) of the two cones meet and the openings (or bases) of the two cones extend outward (opposite one another) results in a bowtie-like appearance. As such, some bicone antennas are called bowtie antennas.

Bicone antennas are generally omni-directional and thus may have low gain. The elevation pattern of a bicone can be directed or shaped using a lens. Such a lens is generally an additional external element that must be positioned within the field of the antenna in order to influence the radiation patterns of the bicone. These external elements may involve additional handling, manufacturing, cost, and complication. They may also reduce mechanical robustness of an antenna assembly. Furthermore, external lens elements may not be available for all bicone systems and may not fulfill specific elevation shaping requirements.

Accordingly, there is a need in the art for a broadband omni-directional bicone antenna with an integrated beam shaping lens where the bicone structure and lens can be machined or molded from a single piece of material.

SUMMARY OF THE INVENTION

The present invention comprises a broadband omni-directional bicone antenna. The inventive antenna typically comprises conical voids provided within a single dielectric body. The surfaces of the conical voids can be metallized to provide conductive cone antenna elements. The outside surface of the dielectric body can support radio frequency (RF) lens structures operable for beam forming. The beam forming achieved by the lens can modify the elevation pattern of the radiation from the bicone antenna. The dielectric body may be machined or molded from a single piece of material to provide both the conical voids as well as the beam shaping lenses. Machining from a single piece of material may reduce material costs, material handling costs, and manufacturing costs.

The outer surface beam shaping lenses can be zoned or continuous and can provide elevation patterns with increased gain, cosecant squared falloff, or various other patterns. The beam forming lens may be formed from any low-loss dielectric. Alternatively, the lens may be formed from a less dense material such as dielectric foam that can support radial conductive beam forming vanes.

The discussion of bicone antennas with integrated beam forming lenses presented in this summary is for illustrative purposes only. Various aspects of the present invention may be more clearly understood and appreciated from a review of the following detailed description of the disclosed embodiments and by reference to the drawings and the claims that follow. Moreover, other aspects, systems, methods, features, advantages, and objects of the present invention will become apparent to one with skill in the art upon examination of the following drawings and detailed description. It is intended that all such aspects, systems, methods, features, advantages, and objects are to be included within this description, are to be within the scope of the present invention, and are to be protected by the accompanying claims.

Figure 1A:
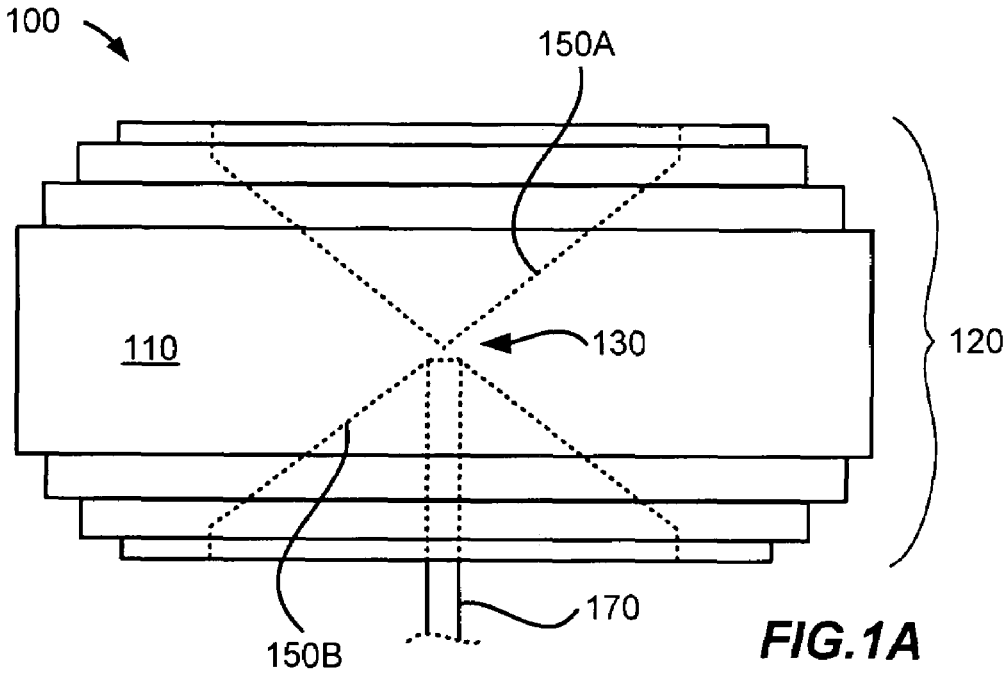
FIGS. 1A and 1B illustrate a bicone antenna system with an integrated beam forming lens supported by a single dielectric structure according to one exemplary embodiment of the present invention.

Many aspects of the invention can be better understood with reference to the above drawings. The elements and features shown in the drawings are not to scale, emphasis instead being placed upon clearly illustrating the principles of exemplary embodiments of the present invention. Moreover, certain dimensions may be exaggerated to help visually convey such principles. In the drawings, reference numerals designate like or corresponding, but not necessarily identical, elements throughout the several views.

DETAILED DESCRIPTION OF EXEMPLARY EMBODIMENTS

The present invention supports a broadband omni-directional bicone antenna comprising conical voids provided within a dielectric structure. The surfaces of the conical voids can be metallized to form conductive cone antenna elements. The outside surface of the dielectric structure can be shaped as radio frequency (RF) lens structures operable for beam forming. The beam forming can modify the elevation pattern of the radiation from the bicone antenna. The dielectric structure may be machined or molded from a single piece of material to provide both the conical voids as well as the beam shaping lenses.

The outer surface beam shaping lenses can be zoned or continuous and can provide elevation patterns with increased gain, cosecant squared falloff, or various other patterns. The beam forming lens may be formed from any low-loss dielectric. Alternatively, the lens may be formed from a less dense material such as dielectric foam that can support radial conductive beam forming vanes.

Exemplary bicone antenna systems with integrated beam forming lenses will now be described more fully hereinafter with reference to FIGS. 1-5, which illustrate representative embodiments of the present invention.

The invention can be embodied in many different forms and should not be construed as limited to the embodiments set forth herein; rather, these embodiments are provided so that this disclosure will be thorough and complete, and will fully convey the scope of the invention to those having ordinary skill in the art. Furthermore, all "examples" or "exemplary embodiments" given herein are intended to be non-limiting, and among others supported by representations of the present invention.

Figure 1B:
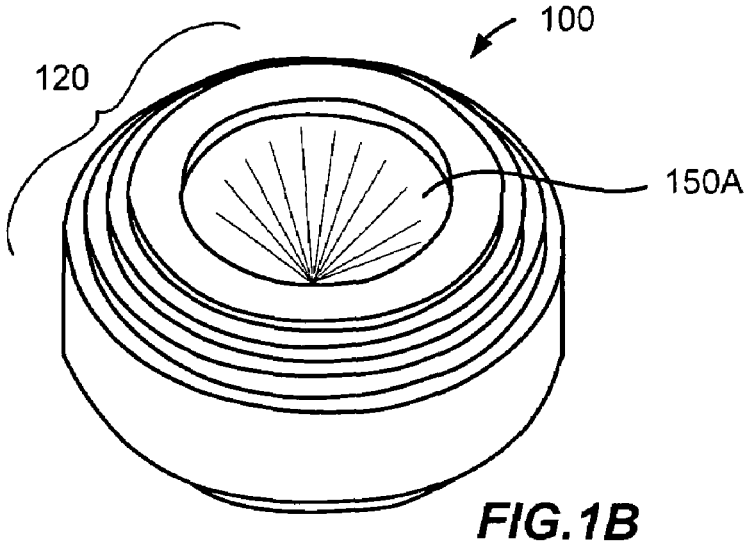

Turning now to FIGS. 1A and 1B, these figures illustrate a bicone antenna system 100 with an integrated beam forming lens 120 supported by a single dielectric structure 110 according to one exemplary embodiment of the present invention. A single piece of dielectric material 110 can be formed to support a bicone structure 150 as well as a beam shaping lens 120. The single piece of dielectric 110 may be formed in many different ways. For example, the single piece of dielectric 110 may be machined, ground, molded, or otherwise shaped as desired.

An upper conical surface 150A can be provided by forming an inverted conical void within the dielectric 110. A lower conical surface 150B can be provided by forming an upright conical void within the dielectric 110. The upper conical surface 150A and lower conical surface 150B may be relatively positioned as to share a common axis. The upper conical surface 150A and lower conical surface 150B may be relatively positioned as to share a substantially common vertex 130. The angle of the upper cone 150A and the angle of the lower cone 150B may the same, substantially the same, or different. The tip of the upper cone 150A or the tip of the lower cone 150B may be blunted or truncated.

The conical surfaces 150 provided within the dielectric 110 can be metallized to form the two conical radiators of the bicone antenna 100. The conical surfaces 150 may be metallized in many different ways. Some examples to metallize the conical surfaces 150 are pressing, adhering, or otherwise positioning a conductive foil or thin sheet to the conical surfaces 150. Some examples to metallize the conical surfaces 150 are plating, depositing, or evaporating a conductive material onto the conical surfaces 150. Some examples to metallize the conical surfaces 150 are supporting cone shaped conductive plates or solid conductive cones within the conical surfaces 150. Some examples to metallize the conical surfaces 150 are providing a conductive mesh, array of wires, or other non-continuous conductive material to the conical surfaces 150. In all examples of metallizing the conical surfaces 150, the conductive material used can be any conductor, such as copper, silver, gold, aluminum, tin, bronze, brass, steel, or any alloy thereof. The metallization itself may be layered, plated, continuous, or discontinuous. The metallization may be formed of different metals or different alloys for different sections or areas of the same antenna system 100.

A feed line 170 can be provided to carry radio frequency energy into or away from the antenna system 100. The feed line 170 may be coaxial, bare conductor, twin-lead, waveguide, rectangular waveguide, circular waveguide, conical waveguide, or any other transmission line. The feed line 170 can be connected to the bicone structure 150 at the vertex 130. The connection may be formed so that one conductor of the feed line 170 is connected to the upper cone 150A and another conductor of the feed line 170 is connected to the lower cone 150B. Additional detail of the feed point at the vertex 130 of the antenna system 100 is discussed below with respect to FIG. 2.

The single dielectric structure 110 of the antenna system 100 can support the bicone structure 150 as well as a beam forming lens 120. The material of the dielectric structure 110 can be any low-loss dielectric. One example material for the dielectric structure is a cross linked polystyrene such as REXOLITE (a trademark of C-Lec Plastics, Inc.). The dielectric structure 110 may be formed of a single piece of material or multiple pieces of material. Sections of the dielectric structure 110 may be formed of dielectric material of differing properties such as different dielectric constants or loss parameters.

A beam forming lens 120 can be provided by shaping the outside surface of the dielectric structure 110. The lens 120 illustrated in FIG. 1 can be considered a Fresnel zone plate. A Fresnel zone pate lens is a zoned lens. Various shapes of lenses 120 can be integrated in the dielectric structure 110. The lenses 120 can be zoned or continuous and can take on almost any shape. Additional examples are discussed in detail below with respect to FIG. 3. The dielectric material of the lens 120 can be thought of as slowing down the electromagnetic energy associated with the metallic bicone 150. Because the dielectric material slows the propagation of the energy, a thicker area of dielectric may slow the energy more than a thinner area of dielectric. This effect can be leveraged to shape a dielectric lens 120 that is operable to form a wave front or beam of electromagnetic energy into a desired shape, or elevation pattern.

Supporting the conical surfaces 150 of the bicone antenna and the beam shaping lens 120 within a single piece of dielectric material 100 may simplify manufacturing, rigidity, and robustness of the bicone antenna system 100. Such simplification may also provide for a lower cost antenna system 100. The bicone antenna system 100 may be used within a radome, within a polarizer, in multiples to form an array of antennas, or in combination with other types of antennas to form an array of antennas. The bicone antenna system 100 can be used as a transmitter to electromagnetically excite the surrounding medium, or also as a receiver that is itself excited by the surrounding medium.

Throughout the discussion of FIGS. 1-5, the conical surfaces are referred to as the upper cone 150A and the lower cone 150B for consistency, however one of ordinary skill in the art will appreciate that the common axis of the conical structures may be vertical, horizontal, or at any desired angle without departing from the scope or spirit of the present invention. That is, the cones may be side-by-side or the upper cone 150A may be positioned below the lower cone 150B.

Figure 2:
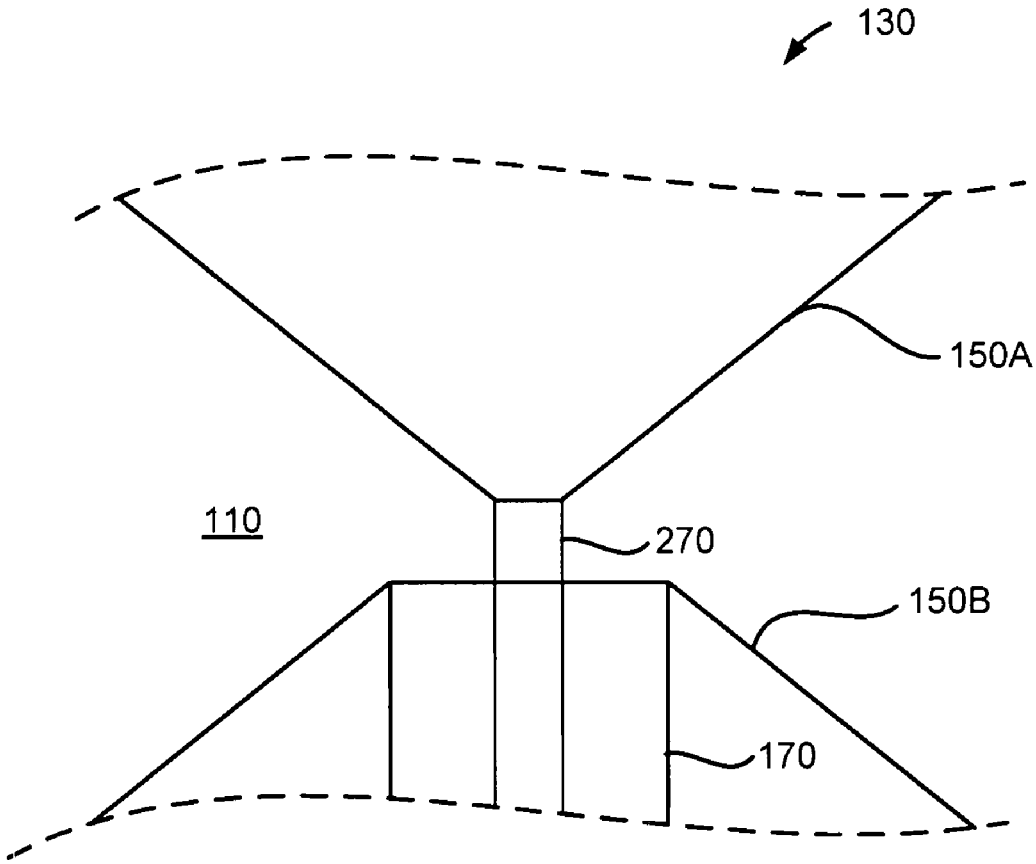
FIG. 2 illustrates a detail view of the feed point within a bicone antenna system according to one exemplary embodiment of the present invention.

Turning now to FIG. 2, this figure illustrates a detail view of the feed point within a bicone antenna system according to one exemplary embodiment of the present invention. A feed line 170 can be connected to the bicone structure 150 at the vertex 130. The feed line 170 can be provided to carry radio frequency energy into or away from the antenna system 100. The feed line 170 may be coaxial, bare conductor, waveguide, rectangular waveguide, circular waveguide, conical waveguide, or any other transmission line. The connection may be formed so that a center conductor 270 of the feed line 170 is connected to the upper cone 150A. An outer conductor of the feed line 170 may be connected to the lower cone 150B. The outer conductor may be the braid or shielding of a coaxial cable. Other types of coaxial or other non-coaxial feed lines 170 or transmission lines may be used to connect to the antenna assembly 100.

The upper conical surface 150A and the lower conical surface 150B may be slightly offset from sharing a common vertex 130; also the vertices of the cones 150 may be slightly blunted to facilitate entry and connection of the feed line 170.

Turning now to FIGS. 3A-3D, the figures illustrate four elevation views of bicone antenna systems with integrated beam forming lenses according to four exemplary embodiments of the present invention. In FIGS. 3A-3D, the conical voids, conical surfaces 150, and the feed line 170 are not illustrated. Outside views of dielectric 110 of exemplary antenna systems 100A-100D are shown to emphasize the shaping of the exterior of the dielectric 110 in order to form four exemplary beam shaping lenses 120. These four lenses are illustrated only as examples and various other beam shaping lenses would be known to one of ordinary skill in the art.

Figure 3A:
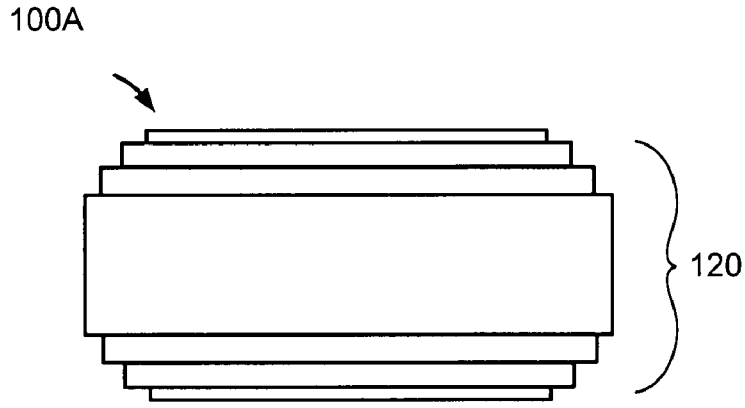
FIGS. 3A-3D illustrate four elevation views of bicone antenna systems with integrated beam forming lenses according to exemplary embodiments of the present invention.
Figure 3B:
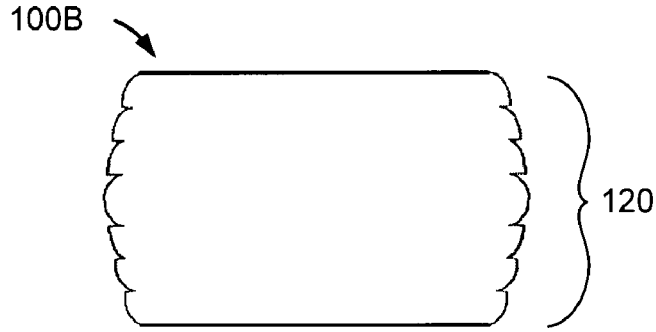
Figure 3C:
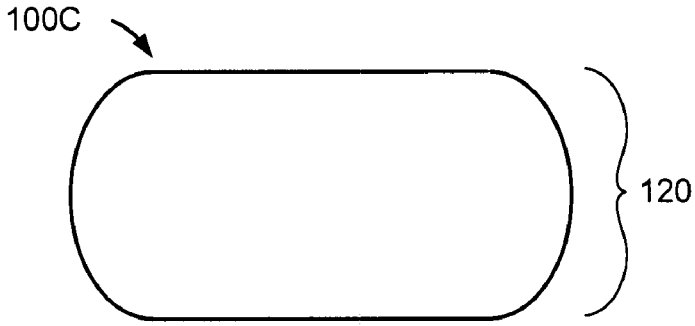
Figure 3D:
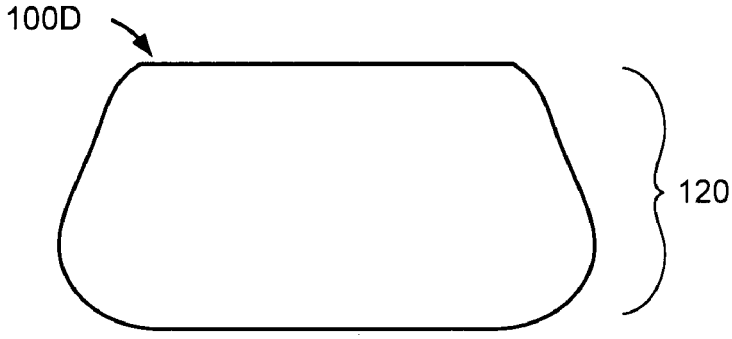

FIG. 3A illustrates a bicone antenna system 100A with a Fresnel zone plate beam shaping lens 120. The Fresnel zone plate is an example of a zoned lens. FIG. 3B illustrates a bicone antenna system 100B with a beam shaping lens 120 known as a Fresnel lens or a lighthouse lens. The Fresnel lens is an example of a zoned lens. FIG. 3C illustrates a bicone antenna system 100C with a curved beam shaping lens 120. The curved lens is an example of a continuous (non-zoned) lens. FIG. 3D illustrates a bicone antenna system 100D with a curved beam shaping lens 120 where the curve is thicker at the bottom. Such a curved lens is an example of a continuous (non-zoned) lens.

The lenses 120 of FIG. 3A-3C may be considered collimating lenses. The omni-directional radiation pattern of a bicone antenna generally has a broadly rounded elevation pattern. Collimation can serve to flatten the elevation pattern thereby providing less electromagnetic energy upward and downward and instead focusing more of the energy radially. That is, more of the energy is radiated in a plane that contains the vertex 130 and is normal to the common axis of the cones 150. Such focusing may increase antenna gain and operational distance.

The lens 120 of FIG. 3D may be used for shaping the bicone radiation pattern into an elevation with a cosecant squared ($csc^2$) falloff. The cosecant squared lens can serve to shape the elevation pattern as to provide less electromagnetic energy upward instead focusing more of the energy downward. For example, such an elevation pattern may be useful when the antenna system 100D is placed at the top of a tower and coverage is desired near the ground close to the tower. Mere collimation may focus much of the energy out along the central radial plane into the distance; while a cosecant squared lens (or similarly bottom heavy lens) may focus some of the energy downward to Earth closer to the tower. Such elevation concerns may also be relevant in aviation communications.

While the bicone antenna is generally broadband, zoned lenses, for example those illustrated in FIGS. 3A and 3B, may be considered to be band-limited since the geometry of the zones may be selected in response to a desired central wavelength of operation. Non-zoned lenses, also known as continuous lenses, such as those illustrated in FIGS. 3C and 3D, can be considered broadband lenses.

Figure 4A:
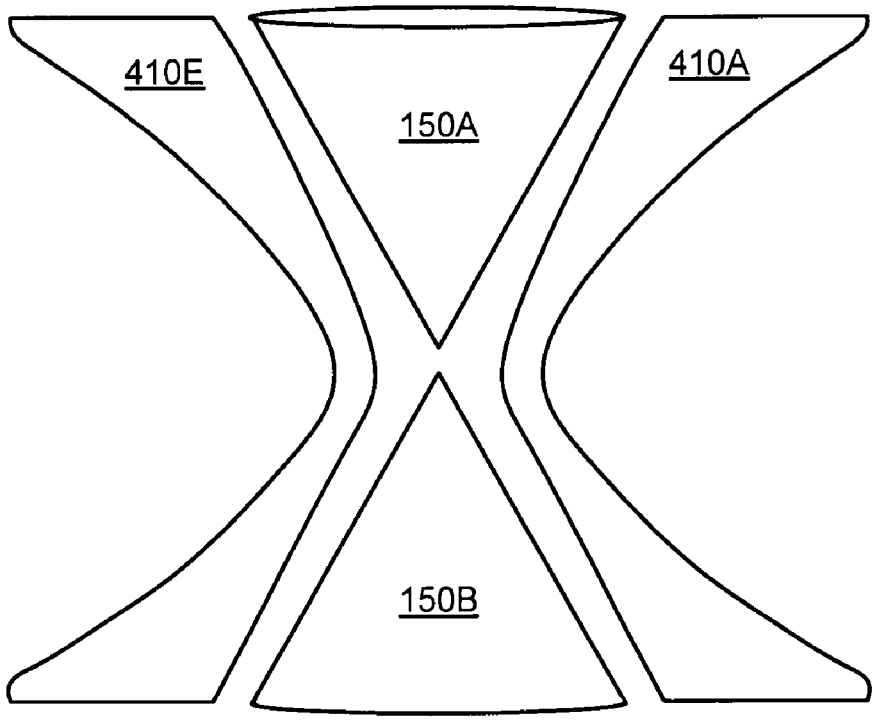
FIG. 4A illustrates an elevation view of a vertically bisected bicone antenna system with an integrated beam forming lens comprising conductive radial vanes according to one exemplary embodiment of the present invention.
Figure 4B:
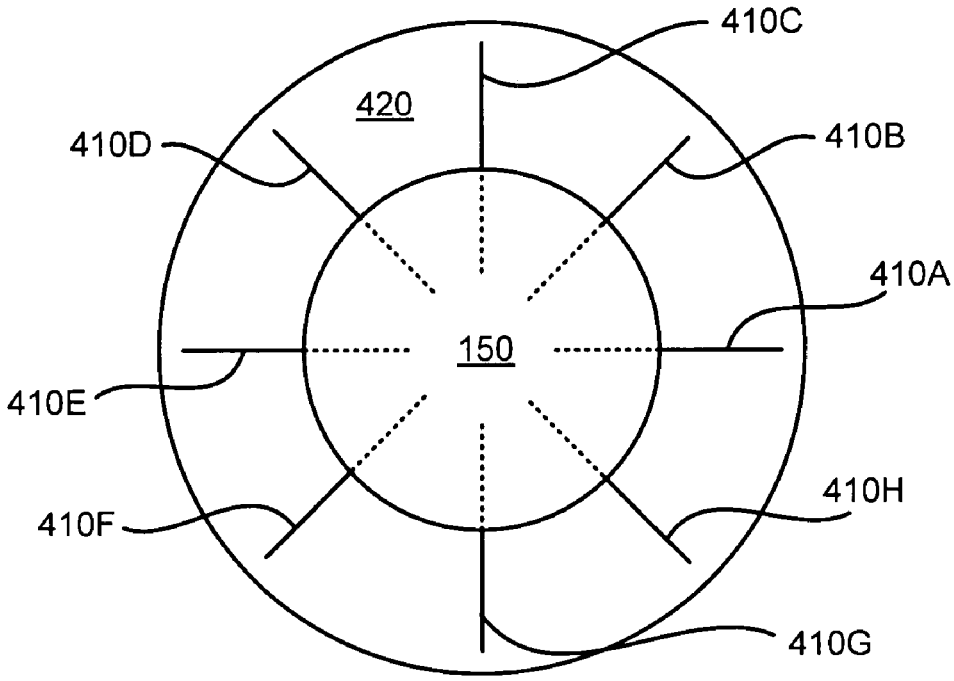
FIG. 4B illustrates a plan view of a bicone antenna system with an integrated beam forming lens comprising eight conductive radial vanes according to one exemplary embodiment of the present invention.

Turning now to FIGS. 4A and 4B, the figures illustrate a bicone antenna system with an integrated beam forming lens comprising conductive radial vanes according to one exemplary embodiment of the present invention. Bicone antennas are generally broadband and their lowest operating frequency can be considered a function of their geometrical scale. More specifically, operation at a lower frequency requires a larger bicone antenna. A low-frequency bicone antenna may be formed as illustrated in FIGS. 1-3, however the density and cost of the low-loss dielectric solid 110 may become prohibitive as the scale of the antenna increases. The weight and expense of the dielectric lens can be reduced by employing a lower density dielectric 420, or foamed dielectric 420, with integrated radial conductive beam forming vanes 410. Slots cut into the low density dielectric 420 can mechanically support and position the conductive beam forming vanes 410.

FIG. 4B illustrates a top view of a bicone antenna system with an integrated beam forming lens 420 comprising eight conductive radial vanes 410. There may be more than eight or fewer than eight radial vanes 410 depending upon the desired operating frequencies. Higher frequency operation may require more vanes 410 then lower frequency operation. A desirable quantity, geometry and positioning of the vanes 410 may be established by calculation or computer simulation.

FIG. 4A illustrates an example of two radial vanes 410A, 410E relative to the bicone structures 150. The conductive vanes may be thought of as speeding up the electromagnetic energy associated with the bicone antenna. This is generally the opposite of the effect of the dielectric lens 120 as discussed earlier, as the all-dielectric lens material slows down the wave propagation. As such, a collimating lens has an opposite shape. That is, the collimating lens with conductive vanes 410A, 410E may be concave or narrower near the vertex of the bicone, while the all-dielectric collimating lenses (illustrated in FIGS. 3A-3C) may be convex or thicker near the vertex. Such relative reduction at the central bulge of the lens as well as the use of lower density dielectric 420 may provide for a lighter and less expensive antenna system for low frequency applications where a solid dielectric antenna system may otherwise be prohibitively heavy or expensive.

Figure 5:
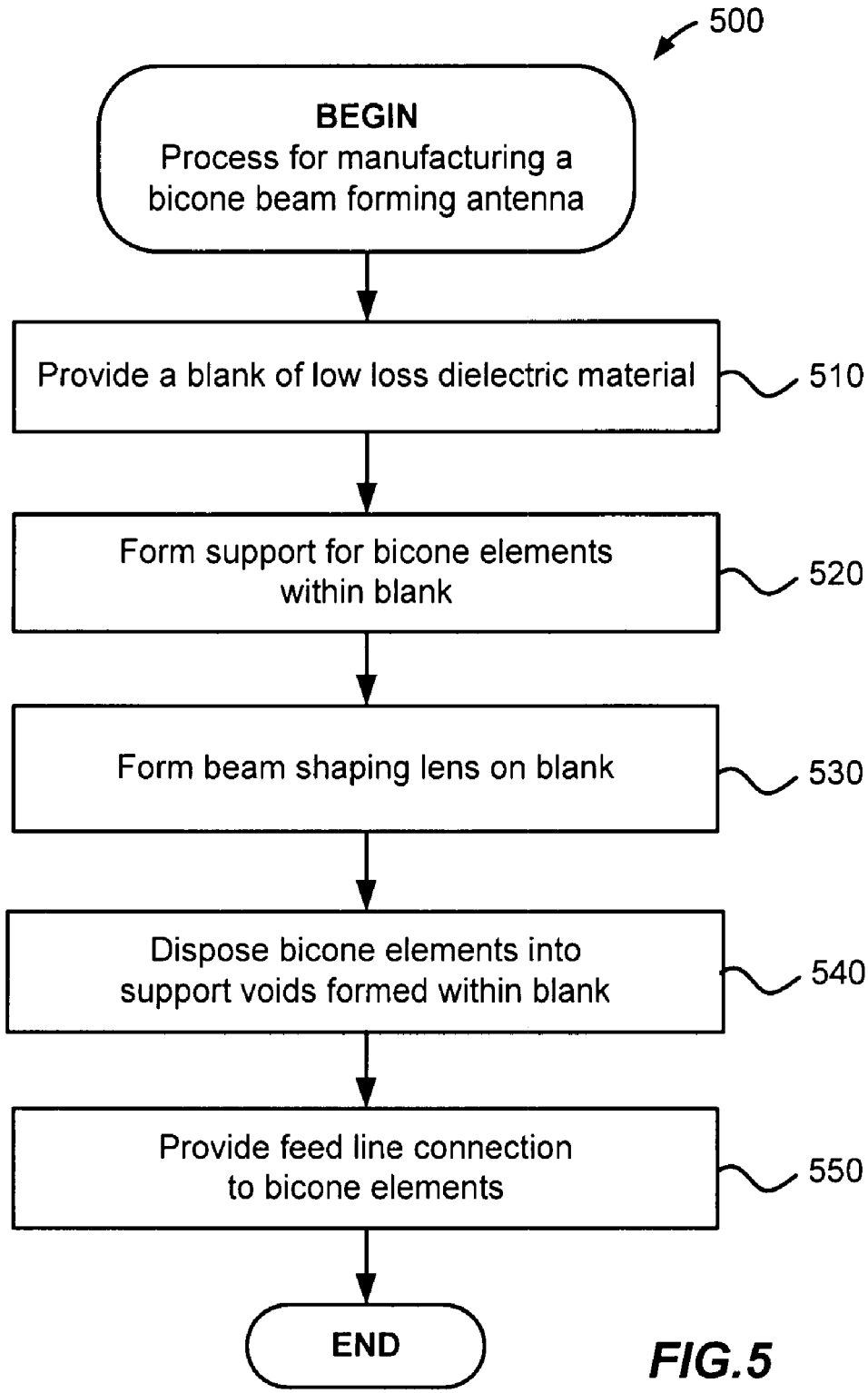
FIG. 5 is a logical flow diagram of a process for manufacturing a bicone beam forming antenna according to one exemplary embodiment of the present invention.

Turning now to FIG. 5, the figure shows a logical flow diagram 500 of a process for manufacturing a bicone beam forming antenna 100 according to one exemplary embodiment of the present invention. Certain steps in the processes or process flow described in the logic flow diagram referred to below must naturally precede others for the invention to function as described. However, the invention is not limited to the order of the steps described if such order or sequence does not alter the functionality of the invention. That is, it is recognized that some steps may be performed before, after, or in parallel with other steps without departing from the scope or spirit of the invention.

In Step 510, a blank of low loss dielectric material 110 is provided. This material can provide the support for the conical surfaces 150 of the bicone antenna as well as the material for the beam forming lens. The step of providing a material blank may also involve proving a material for injection molding. The step of providing a material blank may also involve the use of a low density dielectric 420 for use with radial conductive vanes.

In Step 520, the conical voids 150 that support the bicone elements are formed within the blank of dielectric material 110. Forming conical voids within a solid dielectric 110 can allow for the conductive cones to be any type of material including very thin material (foil for example) to reduce the cost of the conductive cone elements. This may also allow for the use of more expensive conductor material since less of it may be required. The step of forming the conical voids may include machining, forming in a mill or on a lathe, grinding, molding, injection molding, cutting by water, laser, abrasive, or any other technique for forming the conical voids, or cone shaped slots within the dielectric material 110.

In Step 530, a beam forming lens is shaped onto the outer surface of the blank of dielectric material 110. The lens may be of many different shapes including the examples of Fresnel lenses, Fresnel zone plates, curved lenses, or lenses for forming elevation patterns with cosecant squared falloff. The step of forming the dielectric lens may include machining, forming in a mill or on a lathe, grinding, molding, injection molding, cutting by water, laser, abrasive, or any other technique for forming the lens shape onto the dielectric material 110. Step 530 may also include the step of selecting a beam shaping lens geometry to achieve a desired elevation pattern for the bicone antenna In Step 540, the conductive bicone material is formed into the conical voids formed in Step 520. That is, the two conical voids 150 may be metallized in Step 540. The conical surfaces 150 may be metallized in many different ways. Some examples to metallize the conical surfaces 150 are pressing, adhering, or otherwise positioning a conductive foil or thin sheet to the conical surfaces 150; plating, depositing, or evaporating a conductive material onto the conical surfaces 150; supporting cone shaped conductive plates or solid conductive cones within the conical surfaces 150; or providing a conductive mesh, array of wires, or other non-continuous conductive material to the conical surfaces 150. In all examples of metallizing the conical surfaces 150, the conductive material used can be any conductor, such as copper, silver, gold, aluminum, bronze, brass, steel, or any alloy thereof. The metallization itself may be layered, plated, continuous, or discontinuous. The metallization may be formed of different metals or different alloys for different sections or areas of the same antenna system 100.

The step of metallizing the conical surfaces 150 may also include the step inserting conductive beam forming vanes into the dielectric material 420.

In Step 550, a feed line 170 is connected to the bicone elements. This step may also involve applying a connector to the antenna to allow external feed lines to be attached. The feed line 170 may be coaxial, bare conductor, waveguide, rectangular waveguide, circular waveguide, conical waveguide, or any other transmission line. The feed line 170 can be connected to the bicone structure 150 at the vertex 130. The process 500, while possibly run continuously, may be considered complete after Step 550. The process 500 may also include steps of finishing, testing, and packaging or assembly into systems or arrays.

From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the exemplary embodiments, equivalents of the elements shown therein will suggest themselves to those skilled in the art, and ways of constructing other embodiments of the present invention will suggest themselves to practitioners of the art. Therefore, the scope of the present invention is to be limited only by the claims that follow.

What is claimed is:

1. An antenna system comprising:

a substantially cylindrical dielectric solid;

an antenna element coaxially disposed within a void of the dielectric solid and comprising a conical contour; and a beam shaping lens formed from an outside surface of the dielectric solid, the beam shaping lens operable to interact with an electromagnetic field associated with the antenna element.

2. The antenna system of claim 1, wherein the antenna element comprises a metallized surface applied to the void within the dielectric solid.

3. The antenna system of claim 1, further comprising a feed line in electrical communication with the antenna element.

4. An antenna system comprising:

a substantially cylindrical dielectric solid;

an antenna element coaxially disposed within a void of the dielectric solid;

a beam shaping lens formed from an outside surface of the dielectric solid, the beam shaping lens operable to interact with an electromagnetic field associated with the antenna element; and a second antenna element coaxially disposed with another void of the dielectric material, wherein the antenna element and the second antenna element are positioned at opposing sides of the dielectric material and each comprise a metallized surface applied to the corresponding void of the dielectric material.

5. An antenna system comprising:

a substantially cylindrical dielectric solid;

an antenna element coaxially disposed within a void of the dielectric solid; and a beam shaping lens formed from an outside surface of the dielectric solid, the beam shaping lens operable to interact with an electromagnetic field associated with the antenna element, wherein the beam shaping lens comprises a Fresnel lens or a Fresnel zone plate.

6. The antenna system of claim 5, wherein the beam shaping lens comprises a Fresnel lens.

7. An antenna system comprising:

a substantially cylindrical dielectric solid;

an antenna element coaxially disposed within a void of the dielectric solid; and a beam shaping lens formed from an outside surface of the dielectric solid, the beam shaping lens operable to interact with an electromagnetic field associated with the antenna element, wherein the beam shaping lens comprises a curved lens operable to collimate the electromagnetic field and operable to increase an antenna gain of the antenna element.

8. An antenna system comprising:

a substantially cylindrical dielectric solid;

an antenna element coaxially disposed within a void of the dielectric solid; and a beam shaping lens formed from an outside surface of the dielectric solid, the beam shaping lens operable to interact with an electromagnetic field associated with the antenna element, wherein the beam shaping lens comprises a curved lens operable to provide a substantially cosecant squared elevation pattern of the electromagnetic field.

9. An antenna system comprising:

a substantially cylindrical dielectric solid;

an antenna element coaxially disposed within a void of the dielectric solid; and a beam shaping lens formed from an outside surface of the dielectric solid, the beam shaping lens operable to interact with an electromagnetic field associated with the antenna element wherein the beam shaping lens comprises conductive radial vanes.

10. An antenna system comprising:

a dielectric solid comprising a substantially cylindrical geometry;

a void disposed within the dielectric solid, the void comprising a substantially conical geometry and positioned coaxially within the cylindrical geometry;

a metallized surface positioned proximate to the void, the metallized surface operable as an antenna element; and a beam shaping lens formed from an outside surface of the dielectric solid, the beam shaping lens operable to interact with an electromagnetic field associated with the antenna element.

11. The antenna system of claim 10, further comprising a second metallized void within the dielectric solid, the second void comprising a substantially conical geometry, positioned coaxially to the cylindrical geometry, and positioned so that a vertex of the second void is adjacent to a vertex of the void.

12. The antenna system of claim 10, further comprising a feed line in electrical communication with the antenna element.

13. The antenna system of claim 10, wherein the beam shaping lens comprises a Fresnel lens.

14. The antenna system of claim 10, wherein the beam shaping lens comprises a Fresnel zone plate.

15. The antenna system of claim 10, wherein the beam shaping lens comprises a curved lens operable to collimate the electromagnetic field and operable increase an antenna gain of the antenna element.

16. The antenna system of claim 10, wherein the beam shaping lens comprises a curved lens operable to provide a substantially cosecant squared elevation pattern of the electromagnetic field.

17. The antenna system of claim 10, wherein the beam shaping lens comprises conductive radial vanes.

18. A method for manufacturing a bicone beam forming antenna comprising the steps of:

forming cone shaped supports within a dielectric material;

forming a beam shaping lens on an outside surface of the dielectric material;

disposing conductive bicone antenna elements within the cone shaped supports; and providing a feed line in electrical communication with the bicone antenna elements.

19. The method of claim 18, further comprising the step of providing radial beam shaping vanes within the dielectric material.

20. The method of claim 18, wherein the step of forming cone shaped supports comprises machining.

21. The method of claim 18, wherein the step of forming cone shaped supports comprises molding.

22. The method of claim 18, wherein the step of forming a beam shaping lens comprises machining.

23. The method of claim 18, wherein the step of forming a beam shaping lens comprises molding.

24. The method of claim 18, further comprising the step of selecting a beam shaping lens geometry to achieve a desired elevation pattern for the bicone antenna.

* * * * *

UNITED STATES PATENT AND TRADEMARK OFFICE

CERTIFICATE OF CORRECTION

PATENT NO. : 7,525,501 B2
APPLICATION NO. : 11/706580
DATED : April 28, 2009
INVENTOR(S) : Donald N. Black et al.

It is certified that error appears in the above-identified patent and that said Letters Patent is hereby corrected as shown below:

Column 8, Claim 4, lines 21-22, "opposing sides of the dielectric material and each comprise" should read --opposing sides of the dielectric material and each comprises--.

Column 9, Claim 15, line 24, "the electromagnetic field and operable increase an antenna" should read --the elecromagnetic field and operable to increase an antenna--.

Signed and Sealed this

Sixteenth Day of June, 2009

John Doll

JOHN DOLL
*Acting Director of the United States Patent and Trademark Office*